US006529104B1

(12) United States Patent
Small et al.

(10) Patent No.: US 6,529,104 B1
(45) Date of Patent: Mar. 4, 2003

(54) TEMPERATURE COMPENSATED HIGH POWER BANDPASS FILTER

(75) Inventors: Derek J. Small, Raymond, ME (US); John A. Lunn, Portland, ME (US)

(73) Assignee: Andrew Passive Power Products, Inc., Gray, ME (US)

( * ) Notice: Subject to any disclaimer, the term of this patent is extended or adjusted under 35 U.S.C. 154(b) by 0 days.

(21) Appl. No.: 09/505,256

(22) Filed: Feb. 16, 2000

Related U.S. Application Data

(63) Continuation-in-part of application No. 09/251,247, filed on Feb. 16, 1999, now Pat. No. 6,232,852.

(51) Int. Cl.[7] ..... H01P 1/20; H01P 1/30; H01P 7/00

(52) U.S. Cl. ..... 333/208; 333/229; 333/234; 333/210; 333/212; 333/202

(58) Field of Search ..... 333/208, 229, 333/234, 210, 212, 202

(56) References Cited

U.S. PATENT DOCUMENTS

| | | | | |
|---|---|---|---|---|
| 2,528,387 A | | 10/1950 | Niessen | |
| 3,202,944 A | | 8/1965 | Grande | |
| 4,488,132 A | | 12/1984 | Collins et al. | 333/229 |
| 4,630,009 A | | 12/1986 | Tang | |
| 4,677,403 A | * | 6/1987 | Kich | 333/229 |
| 4,706,053 A | | 11/1987 | Giavarini | |
| 5,374,911 A | * | 12/1994 | Kich et al. | 333/209 |
| 5,428,323 A | | 6/1995 | Geissler et al. | |
| 5,589,807 A | | 12/1996 | Tang | |
| 5,867,077 A | * | 2/1999 | Lundquist | 333/208 |
| 5,905,419 A | * | 5/1999 | Lukkarila | 333/202 |
| 6,002,310 A | | 12/1999 | Kich et al. | 333/208 |
| 6,232,852 B1 | | 5/2001 | Small et al. | 333/208 |

FOREIGN PATENT DOCUMENTS

JP 61218522 4/1988

OTHER PUBLICATIONS

Paul A. Goud; Cavity Frequency Stabilization with Compound Tuning Mechanisms; Dept. of Electrical Engineering, University of Alberta, Edmonton, Alberta, Canada; Mar., 1971; pps. 55–56 and 58.

Wher, Joroslow, Bornemann, Jens, and Rosenber, Urve, Waveguide Components for Antenna Feed Systems, (Artech House), pp. 237–248.

"Theory of Direct Coupled Cavity Filters," *IEEE Trans. on Microwave Theory and Techniques*, vol. MTT–15, Jun. 1967, pp. 340–348.

(List continued on next page.)

*Primary Examiner*—Patricia Nguyen
(74) *Attorney, Agent, or Firm*—Jenkens & Gilchrist

(57) ABSTRACT

A bandpass filter makes use of at least one waveguide cavity that is thermally compensated to minimize drift of a resonant frequency of the cavity with thermal expansion of cavity components. The compensation relies on deformation of the shape of at least one cavity surface in response to thermally induced dimensional changes of the cavity. A control rod is used to limit the movement of a point on the deformed surface, while the rest of the surface moves with the thermal expansion. The control rod is made of a material having a coefficient of thermal expansion that is significantly different than that of other filter components. The rod may also be arranged to span more thermally expandable material than defines the filter such that, as the filter expands, the point of deflection is moved toward the interior of the filter beyond its original position. In an alternative embodiment, an end plate of each cavity is secured to the rest of the cavity along its periphery, and has a convex shape facing away from an interior of the cavity. As the cavity expands radially, it forces the convexity of the end plate inward, compensating for the expansion in other cavity dimensions.

43 Claims, 6 Drawing Sheets

OTHER PUBLICATIONS

"Evanescent–Mode Coupling of Dual–Mode Rectangular Waveguide Filters," *IEEE Trans. On Microwave Theory and Techniques*, vol. MTT–39, Aug. 1991, pp 1307–1312.

"A Novel Coupling Method for Dual–Mode Dielectric Resonators of Waveguide Filters," *IEEE Trans. On Microwave Theory and Techniques*, vol. MTT–38, Dec. 1990, pp. 1885–1893.

* cited by examiner

TEMPERATURE COMPENSATED HIGH POWER BANDPASS FILTER

CROSS-REFERENCE TO RELATED APPLICATIONS

This application is a continuation-in-part of U.S. patent application Ser. No. 09/251,247, filed Feb. 16, 1999, now U.S. Pat. No. 6,232,852 B1.

FIELD OF THE INVENTION

The invention relates generally to the field of electromagnetic signal communication and, more particularly, to the filtering of high power signals for broadcast communications.

BACKGROUND OF THE INVENTION

In the field of broadcast communications, electrical filters are required to separate a desired signal from energy in other bands. These bandpass filters are similar to bandpass filters in other fields. However, unlike most other electrical bandpass filters, filters for broadcast communication must be capable of handling a relatively high input power. For example, a signal input to a broadcast communications filter might have an average power between 5 and 100 kilowatts (kW). Many electronic filters do not have the capacity for such large signal powers.

For many years, high power electrical bandpass filtering has included the use of waveguide cavity filters. In particular, the introduction of dual-mode cavities for microwave filters in 1971 made a significant contribution to the art. Dual-mode filters allowed for a reduction in filter size and mass, and could realize more complex filter functions by their ability to easily couple non-adjacent resonators. Later reductions in size and mass were achieved with the introduction of triple and quadruple mode filters.

While dual-mode waveguide cavity filters have been used often for space and satellite communications, they have also been used for terrestrial television broadcast applications. Indeed, for transmitters operating in a common amplification mode (i.e., a mode in which both audio and video signals are being amplified together), dual-mode filters have become predominant because of their low loss and ability to realize complex filter functions. Moreover, dual-mode filters have been favored for the transmission of analog television signals because of their flexibility in realizing wide pass bandwidths to compensate for frequency drift due to RF heating and ambient temperature changes. However, with the advent of digital television, system requirements have changed. The FCC emissions mask for digital television broadcast stations is very restrictive for power radiated into adjacent channels or out-of-band frequencies. These requirements will not be satisfied by filters that have wide passbands that are allowed to drift.

In the past, waveguide cavities have been developed that are adjustable to compensate for thermal expansion. Paul Goud in *Cavity Frequency Stabilization with Compound Tuning Mechanisms,* Microwave Journal, March 1971 discloses a waveguide cavity that may be adjusted to compensate for thermal expansion. In FIG. 2 of the article, Goud shows a compound tuning mechanism that may be used to change the effective length of the filter cavity. However, this tuning mechanism requires a manual adjustment of a screw device to make the necessary changes. Moreover, the movable surface is based on a two-section choke. This choke must be unconnected to the sides of the filter, so that it may be moved relative to them. As such, the cavity is unsealed, and is prone to leakage and poorer performance than a sealed filter.

More recently, filter design has addressed the need for narrower bandwidth filters by constructing filters from materials with lower thermal expansion coefficients to minimize the effect of heating on the filter dimensions. In particular, the nickel/steel alloy Invar® (a registered trademark of Imphy, S.A., Paris, France) has been used as a cavity material. Because of its extremely low degree of thermal expansion, the cavities built with Invar® suffer less of a dimensional change with heating, and therefore maintain a narrower, more stable passband. However, Invar is also very expensive, and consequently drives up the overall cost of the filter.

SUMMARY OF THE INVENTION

In accordance with the present invention, a bandpass filter is provided that uses the deformation of a cavity surface in response to thermal changes to compensate for the resonant frequency shifting effects of thermal expansion. The filter has at least one waveguide cavity in which an input electrical signal resonates at a desired resonant frequency, and a plurality of surfaces, each with a predetermined geometric shape. For example, in a preferred embodiment, the filter has a cylindrical outer surface and a circular end plate. A thermal compensator is provided that responds to thermally induced changes in dimensions of the cavity by distorting the shape of one of the cavity surfaces, thereby minimizing any resulting drift in the resonant frequency.

Typically, the thermally induced changes in the cavity are an increase in cavity dimensions, and the thermal compensator deflects one of the cavity surfaces inward, such as in the case of a concave deflection of the cavity end plate. In the preferred embodiment, the thermal compensator includes a control rod that limits the movement of at least a first point on an end plate of the cavity in a first direction. That is, the control rod prevents movement of that point in the direction of thermal expansion. Thus, as the cavity expands, outer portions of the end plate move in the direction of the expansion, but the first point is restricted by the control rod. As a result, the end plate is deformed from its original shape. The control rod has a coefficient of thermal expansion that is significantly different (typically lower) than that of a material from which the cavity is constructed.

In one embodiment, the control rod fixes a point on the cavity end plate relative to a different location on the filter. This different location may be such that the control rod spans more thermally expanding material than that which defines the waveguide cavity. In such a case, the thermal expansion causes the point of deflection to be moved relative to its original position. In other words, whereas the deflection point initially resides in a first plane perpendicular to the direction of thermal expansion, the expansion of the thermally expanding material spanned by the control rod forces the deflection point out of its original plane toward an interior of the cavity. In another embodiment, a similar inward movement of the deflection point may be accomplished by using an end deflecting rod that connects the control rod to the deflection point. If the end deflecting rod has a coefficient of thermal expansion that is significantly higher than that of the control rod, its expansion will force the deflection point inward relative to the control rod. Naturally, these two techniques may also be combined.

In determining the appropriate amount that a cavity surface point should be deflected, a theoretical model may be used to first establish how far a movable end plate would have to be moved to compensate for an expansion of the waveguide cavity without the end plate being distorted. The resulting deflection distance may then be augmented to compensate for the fact that, in the present invention, the entire surface is not being moved. This additional deflection may be determined empirically, and can provide a more accurate compensation for control of the cavity resonant frequency.

In a preferred embodiment, the waveguide cavity is one of two cavities, which are coupled together via an iris plate. Each of the cavities may be thermally compensated in the manner described herein. One particularly preferred embodiment is a six section filter consisting of two thermally compensated waveguide cavities, each with two orthogonal resonant modes, and two coaxial resonators, each coupled to one of the waveguide cavities via an impedance inverter. The signal to be filtered is input through one of the coaxial resonators to one of the waveguide cavities and output through the other coaxial resonator.

In an alternative embodiment, control rods are not used but, instead, a surface of each waveguide cavity is fixed relative to the remainder of the cavity, and has an inner surface shaped to counteract any increase in cavity volume resulting from thermal expansion. In particular, an end plate of the cavity may be given a convex shape, with the convex portion extending away from the interior of the cavity. That is, the end plate may be "dome-shaped," and secured along its periphery to as main portion of the cavity. Relative to a plane in which the end plate is connected to the remainder of the cavity, its convexity projects away from an interior of the cavity. As temperature increases cause thermal expansion of the cavity in a radial direction, the end plate experiences stress in directions perpendicular to an axis of symmetry of its convexity. It is thereby pulled radially outward, causing the convex portion of the end plate to be forced to a flatter profile, deflecting toward the interior of the cavity. As a result, the change in shape of the end plate tends to counter any volume expansion that would otherwise result from the thermal expansion of the cavity, and inhibits corresponding shifts in the filter frequency response.

DETAILED DESCRIPTION OF THE PREFERRED EMBODIMENTS

Figure 1:
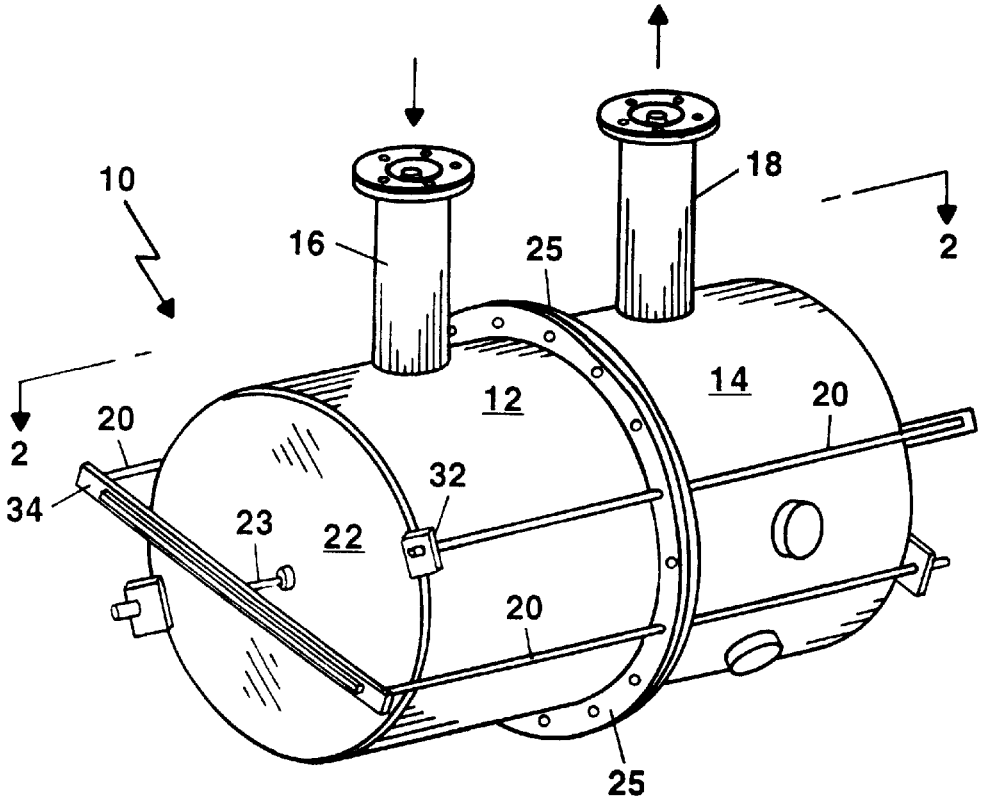
FIG. 1 is a perspective view of a bandpass filter according to the present invention.
Figure 2:
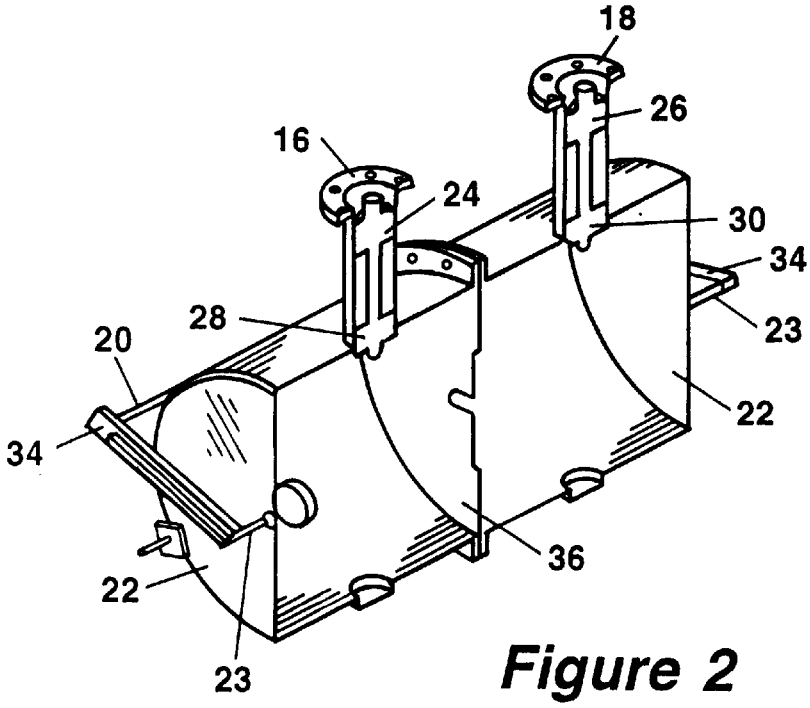
FIG. 2 is a cross sectional perspective view of the filter of FIG. 1.

Shown in FIG. 1 is a perspective view of a temperature compensated pseudo-elliptical function mixed mode bandpass filter 10. The filter of FIG. 2 is particularly suitable for high power broadcast applications, and has an aluminum $TE_{11}$ cavity consisting of cavity portion 12 and cavity portion 14. The filter 10 also has an input stage 16 containing a coaxial resonator, and an output stage 18 containing a coaxial resonator. The filter uses a set of thermal control rods to control the position of the center point of each of two cavity end plates 22 relative to an opposite end of the cylindrical cavity housing. This causes the end plates 22 to deflect when the aluminum cavity housing expands, thereby minimizing thermal drift of the filter pass band due to dimensional changes of the filter cavities.

The filter 10 is shown in cross section in FIG. 2. A coaxial cable (not shown) is connected to filter input stage 16 to allow signal input to the filter. Likewise, the filter output is directed to a coaxial cable (not shown) via output stage 18. Each of the input and output stages consists of a respective TEM coaxial resonator 24, 26. The coaxial resonators use inner conductors of a material with a low coefficient of thermal expansion, such as Invar, to provide them with good temperature stability. That is, the use of Invar inner conductors gives the TEM resonators good dimensional stability, and therefore good frequency stability, with changes in temperature. The input coaxial resonator 16 also uses an impedance inverter 28 for coupling into the waveguide cavity. Likewise, the output coaxial resonator uses an impedance inverter 30 for coupling out of the cavity.

Impedance inverters are found in most microwave RF filter designs, and not discussed in any great detail herein. In the filter of FIG. 1, the impedance inverters have the effect of converting the shunt inductance-capacitance of the each of the coaxial resonators to an inductance-capacitance in series with the waveguide cavity stages. That is, the impedance inverters enable the resonant filter characteristics of the coaxial resonators to be series coupled with the resonant filter characteristics of the waveguide cavity filter stages. Similarly, the iris plate 36 separating the two waveguide cavities functions as an impedance inverter between those two stages. The use of TEM mode coaxial resonators with the dual cavity resonator provides a particular mixed mode that increases the spurious suppression as compared to a filter based on a pure $TE11_n$ mode design, since the filter band of each coaxial resonator blocks noise outside of the pass band it defines.

As mentioned above, control rods provide thermal stability to the cavity waveguide. In the embodiment of FIGS. 1 and 2, the filter includes side bracing control rods 20 and end deflecting rods 23. Unlike the other components of the waveguide stages, such as the aluminum cavity housing, the side bracing control rods are made of a material having a very low coefficient of thermal expansion, such as Invar. Meanwhile, the end deflecting rods 23 are preferably aluminum, for reasons that are discussed in more detail hereinafter. The control rods 20 and end deflecting rods 23 are arranged in two control assemblies that control the position of the center of each end plate 22 relative to the edge of the cavity housing at the opposite end of the adjacent cavity.

As shown, each control assembly has two side bracing rods 20, each of which is secured at one end by a mounting clip 32 to the edge of the cavity housing. At the opposite end, the bracing rods 20 are fixed to a lateral support 34. The side bracing control rods 22 each reside within a pair of "pass-through" holes in mounting plates 25. Mounting plates 25 provide the means by which to fasten the two cavity housings 12, 14 together and to secure the iris plate 36 separating the cavities. The center of each of the lateral supports 34 is secured to an end deflecting rod 23 that maintains a fixed distance between its respective support and the center of the adjacent end plate 22. Thus, a first bracing assembly establishes a bracing frame between the edge of cavity 12 and the center of the end plate of cavity 14, while the other bracing assembly maintains a bracing frame between the edge of cavity 14 and the center of the end plate of cavity 12.

Because of its relatively small thickness in the axial dimension of the filter (i.e., in a direction parallel to the longitudinal axis of the control rods), the thermal expansion of the lateral supports is negligible for the expected operating temperature range of the filter. Furthermore, the embodiment of FIGS. 1 and 2 shows only two bracing assemblies of three control rods each. However, those skilled in the art will recognize that additional control rods may be used, if desired. However, the use of only two assemblies helps to minimize the amount of low expansion coefficient material, the cost of which represents a significant manufacturing expense.

It is known in the art that the resonant frequency $f$ of a cylindrical $TE11_n$ cavity may be expressed as:

$$f = c\sqrt{\left(\frac{x}{\pi}\right)^2 \frac{1}{D^2} + \left(\frac{n}{2}\right)^2 \frac{1}{L^2}}$$

where c is the speed of light, D is the cavity diameter, L is the cavity length, n is the number of half wavelengths that contained in the distance L, and x is a zero of a Bessel function dependent on the mode being considered. For example, if n=1 (i.e., the cavity is a $T_{111}$ cavity), x=1.841. It has also been shown that this equation may be differentiated with respect to temperature to give the relationship:

$$\frac{1}{f}\frac{\Delta f}{\Delta T} = -\frac{\left(\frac{D}{L}\right) + \frac{d}{\Delta T}\left(\frac{D}{L}\right)}{\left(\frac{D}{L}\right)^2 + A^2} - \frac{1}{D}\frac{\Delta D}{\Delta T}$$

where:

$$A = \frac{2x}{n\pi}$$

From this, some of the desired parameters of the waveguide may be determined.

Since the equation above represents the frequency changes in a cylindrical cavity filter with changes in temperature, a stable cavity construction may be determined by setting this equation equal to zero. In other words, when $$\frac{1}{f}\frac{\Delta f}{\Delta T} = 0,$$

the filter cavity is stable with temperature. By substitution and reduction, the following relationship results:

$$\left(\frac{1}{L}\right)\frac{\Delta L}{\Delta T} = -A^2\left(\frac{L}{D}\right)^2\left(\frac{1}{D}\right)\frac{\Delta D}{\Delta T}$$

Notably, the coefficient of thermal expansion for the length of the cavity ($CTE_L$) is proportional to:

$$\left(\frac{1}{L}\right)\frac{\Delta L}{\Delta T}$$

and the coefficient of thermal expansion for the cavity diameter ($CTE_D$) is proportional to:

$$\left(\frac{1}{D}\right)\frac{\Delta D}{\Delta T}$$

Thus, for a thermally stable cylindrical cavity, the ratio of $CTE_L$ to $CTE_D$ may be expressed as:

$$\frac{CTE_L}{CTE_D} = -A^2\left(\frac{L}{D}\right)^2$$

The relationship above may be used to modify the length of the cavity to compensate for changes in cavity diameter so as to keep the resonant frequency of the cavity stable. A particular cavity design has a predetermined length and diameter, as well as a particular value for each of the mode-specific variables x and n that make up A. Thus, for that cavity, a particular value for the ratio of $CTE_L$ to $CTE_D$ can be found. Given that ratio, one may determine how one of those parameters must be changed relative to the other in order to maintain a stable resonant frequency. This provides the basis for the thermal compensation of the cavity. For example, if a cavity had a diameter D=17" and a length L=18", and a value for A of 1.172 (given, e.g., x=1.84 and n=1), then the ratio of $CTE_L$ to $CTE_D$ would be −1.54. Therefore, to maintain the resonant frequency of the cavity, an increase in its diameter must be met with a reduction its length (since the ratio is negative), where the length change has a magnitude of 1.54 times the diameter change.

While an adjustment mechanism might be used to physically move one or both of the end plates of the filter cavity in response to changes in its diameter, this would require the use of chokes or "bucket shorts" so that the mechanical changes in the cavity shape could be made. Such movable end plates tend to reduce the performance of the filter, and are therefore undesirable. Therefore, in the present invention, rather than moving the cavity end plates, the cavity shape is deformed to compensate for the frequency shifts. The preferred embodiment accomplishes this by using a combination of materials having different coefficients of thermal expansion in such a way as to force a particular deformation in response to temperature changes.

Because of the use of cavity deformation, the mathematical analysis provided above may not apply precisely for temperature compensation. In the preferred embodiment, empirical data is used to augment an initial determination of how the cavity would be modified if a cylindrical shape were maintained. The following example demonstrates such a design, and represents a preferred embodiment of the invention.

One prominent area of use for waveguide cavity filters is in broadcast communications. In particular, ultra-high frequency (UHF) channels for digital television (DTV) have frequency allocations in the United States from approximately 473 MHz (channel 14) to 749 MHz (channel 60). It is known in the art that the optimum Q is achieved in $TE_{111}$ mode cavity filters with a D/L ratio of approximately 1 to 3. Given this characteristic, it has been found that reasonable performance may be achieved using a filter cavity having a diameter of 17" for channels 14 through 40 (frequencies from 473 MHz to 629 MHz). In these filters, the length of the cavity is dependent on the desired center frequency. Similarly, it has been found that a filter cavity having a diameter of 15" is satisfactory for channels 41–60 (frequencies from 635 MHz to 749 MHz). The ranges for desirable filter parameters for UHF communications systems is shown in the following table:

TABLE 1

| Channel No. | Frequency (MHz) | Diameter (in.) | D/L | $CTE_L/CTE_D$ |
|---|---|---|---|---|
| 14 | 473 | 17 | 0.7O | −2.80 |
| 40 | 629 | 17 | 1.38 | −0.72 |
| 41 | 635 | 15 | 1.11 | −1.10 |
| 60 | 749 | 15 | 1.50 | −0.62 |

As shown, the ratios of $CTE_L$ to $CTE_D$ for these filters range from −0.62 to −2.80. Thus, using the formulae above, the change in length to compensate for diametric expansion can be calculated. However, because the preferred embodiment relies on cavity deflection, rather than a movable end plate, an adjustment must be made to the calculated value.

The foregoing analysis may be applied to a filter construction as shown FIGS. 1 and 2. In that embodiment, the control rods 20 control the position of the center of one cavity end plate 22 relative to the opposite side of the adjacent cavity 14. As mentioned previously, the aluminum of the cavity housings and the end deflecting rod 23 has a much higher coefficient of thermal expansion than the Invar, and so each cavity is forced to deform as the temperature increases. The appropriate parameters for constructing a UHF filter according to the embodiment of FIGS. 1 and 2 may be demonstrated using the model shown in FIG. 3.

Figure 3:
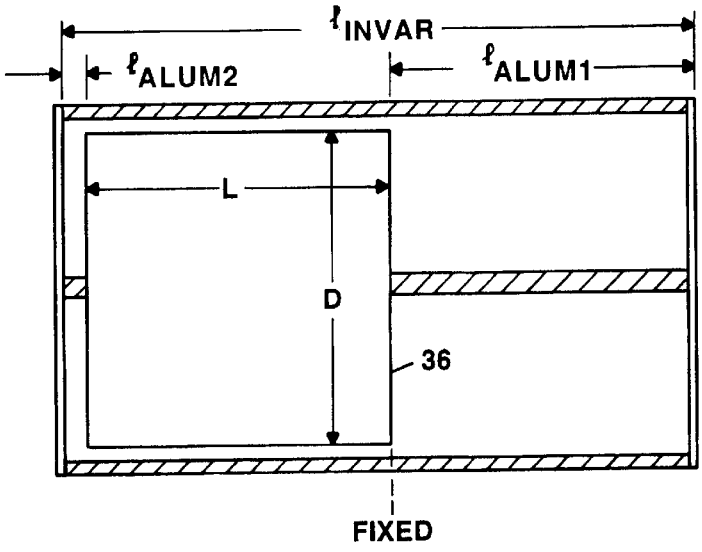
FIG. 3 is a schematic model useful in making a determination of deflection distance for thermal compensation of the filter of FIG. 1.
Figure 4:
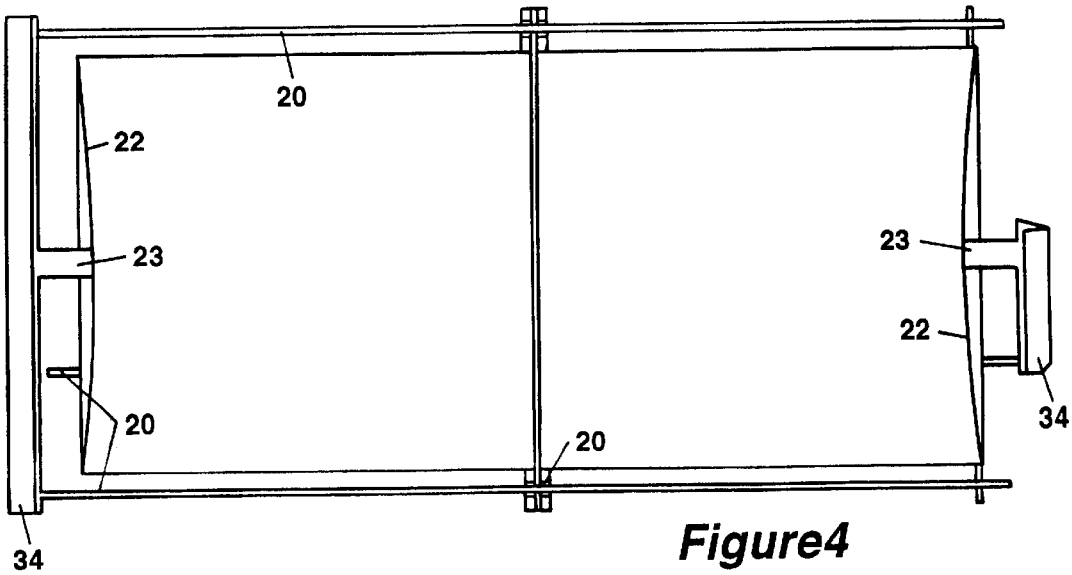
FIG. 4 is a cross-sectional side view of the filter of FIG. 1 in a high temperature state.

FIG. 3 provides a model that corresponds to the design of one of the cavities 12, 14 of the filter 10 of FIGS. 1 and 2. It will be described in the context of cavity 12 to demonstrate how the different filter components affect the cavity deformation with temperature. As shown in FIG. 3, the center point of the model is the iris plate 36, and it has a fixed position for the purposes of this analysis. The distance $l_{ALUM}$ corresponds to the length of the aluminum material of the waveguide cavity and the end deflecting rod 23. The overall length $l_{ALUM}$ is the sum of $l_{ALUM1}$, which is the length of the aluminum housing that affects the end plate, and $l_{ALUM2}$, which is the length of the aluminum end deflecting rod 23. The distance $l_{INVAR}$ corresponds to the length of the Invar rods 20.

As can be seen from FIG. 3, an increase in temperature will cause a thermal expansion in both the aluminum material and the Invar material. However, this expansion will be greater for the aluminum material, since the coefficient of thermal expansion of aluminum is much higher than that of Invar. Indeed, the net change per degree Celsius in the distance between iris plate 36 and the center point of end plate 22 of cavity 12 is may be written as:

$$CTE_{CP}=CTE_{ALUM}-CTE_{INVAR}$$

To determine an optimum length for the two materials given a filter having a particular center frequency, an approximation is first made using the filter adjustment relationships described above for a cavity in which end plate position may be adjusted without cavity deformation. Known filter parameters are also used, such as those shown above in Table 1, to optimize for the desired frequency. This is demonstrated by the following example.

If a filter having a center frequency of 749 Mhz is desired, a 15" cavity may be used. From Table 1, the ratio of $CTE_L$ to $CTE_D$ for this frequency is −0.62. Substituting this into the equation above gives the following relationship:

$$-0.62(CTE_D)(D)=(CTE_{ALUM})(l_{ALUM})-(CTE_{INVAR})(l_{INVAR})$$

The thermal expansion coefficient for aluminum is $CTE_{ALUM}=24.7\times10^{-6}$, while the thermal expansion coefficient for Invar is $CTE_{INVAR}=1.6\times10^{-6}$. Since the cavity is aluminum, $CTE_D=CTE_{ALUM}$. The foregoing equation may therefore be written as:

$$-0.62(24.7\times10^{-6})(15)=(24.7\times10^{-6})(l_{ALUM})-(1.6\times10^{-6})(l_{INVAR})$$

or, if $(l_{alum}+L)$ is substituted for $l_{INVAR}$, $$-0.62(24.7\times10^{-6})(D)=(24.7\times10^{-6})(l_{ALUM})-(1.6\times10^{-6})(l_{ALUM}+L)$$

Given the D/L ratio from table 1, L=10 may be used, and the equation solved to give a value of $l_{ALUM}=9.25$. For an initial cavity length L=10, this corresponds to an Invar rod length of $l_{INVAR}=19.25$.

These values could be used in the filter of FIG. 1 to provide an approximate solution for thermal compensation. However, as discussed above, the filter of FIG. 1 does not use an end plate that moves in its entirety, and does not maintain the cylindrical shape of the cavity. Instead, to make the filter simpler and less costly to manufacture and to prevent degradation of the filter Q, the end plate 22 of cavity 12 is allowed to deform in a concave manner. Experimentation has shown that, for the filters having center frequencies in the UHF range, an additional 15% deflection of the end plate 22 of cavity 12 increases the accuracy of the compensation, and provides the resonance frequency with better stability.

As mentioned above, the present invention currently makes use of some empirical steps in determining an appropriate degree of deformation to be applied to the cavity end plate. The formulaic method above may be used to determine what an appropriate adjustment to the position of the end plate would be if no deformation of the surface was taking place. This provides a cavity parameter, in this case length, that serves as a starting point for determining the appropriate degree of cavity deformation. Thereafter, heating of the cavity and minor adjustment in the deformation, combined with measurement of the filter characteristics, allow fine-tuning of the degree of deformation. Given the description herein, such modifications are well within the ability of one skilled in the art. An example of this process is described below.

After determining an initial deflection amount from the formulae, a low power signal from a network analyzer is input to one port of the filter, and received at the other port. The scattering parameters ("S-parameters") and temperature of the filter are then measured and recorded. From the S-parameters, the center frequency is found and recorded. The filter unit is then heated in a chamber in order to obtain a change in temperature. Once the frequency response and temperature of the filter have stabilized, the S-parameters and filter temperature are again recorded. At this point, the resonant frequency of the filter will have drifted down a small amount. To compensate, the value of $l^{ALUM}$ is increased relative to $l_{INVAR}$. To increase $l_{ALUM}$, the length of the end deflecting rod 23 may be increased. Alternatively, the length of the invar rods 20 may be increased. This has the same effect, since the larger the distance between the end plate being deflected and the opposite connection point of the rods 20 on the housing, the more length of the aluminum housing there is to move the outer portions of the end plate as it expands.

By readjusting the length of $l_{ALUM}$ relative to $l_{INVAR}$ according to the measured resonant frequencies at different temperatures, the optimum length may be determined. As mentioned, for the embodiment above, this required an additional 15% deflection of the end plate. However, those skilled in the art will recognize that for other filter dimension, resonant frequencies, or even types and locations of cavity deformation, different degrees of variation may apply. Nevertheless, by applying empirical modifications, as described above, to a theoretically ideal surface movement model, the appropriate filter characteristics may be achieved.

Figure 5:
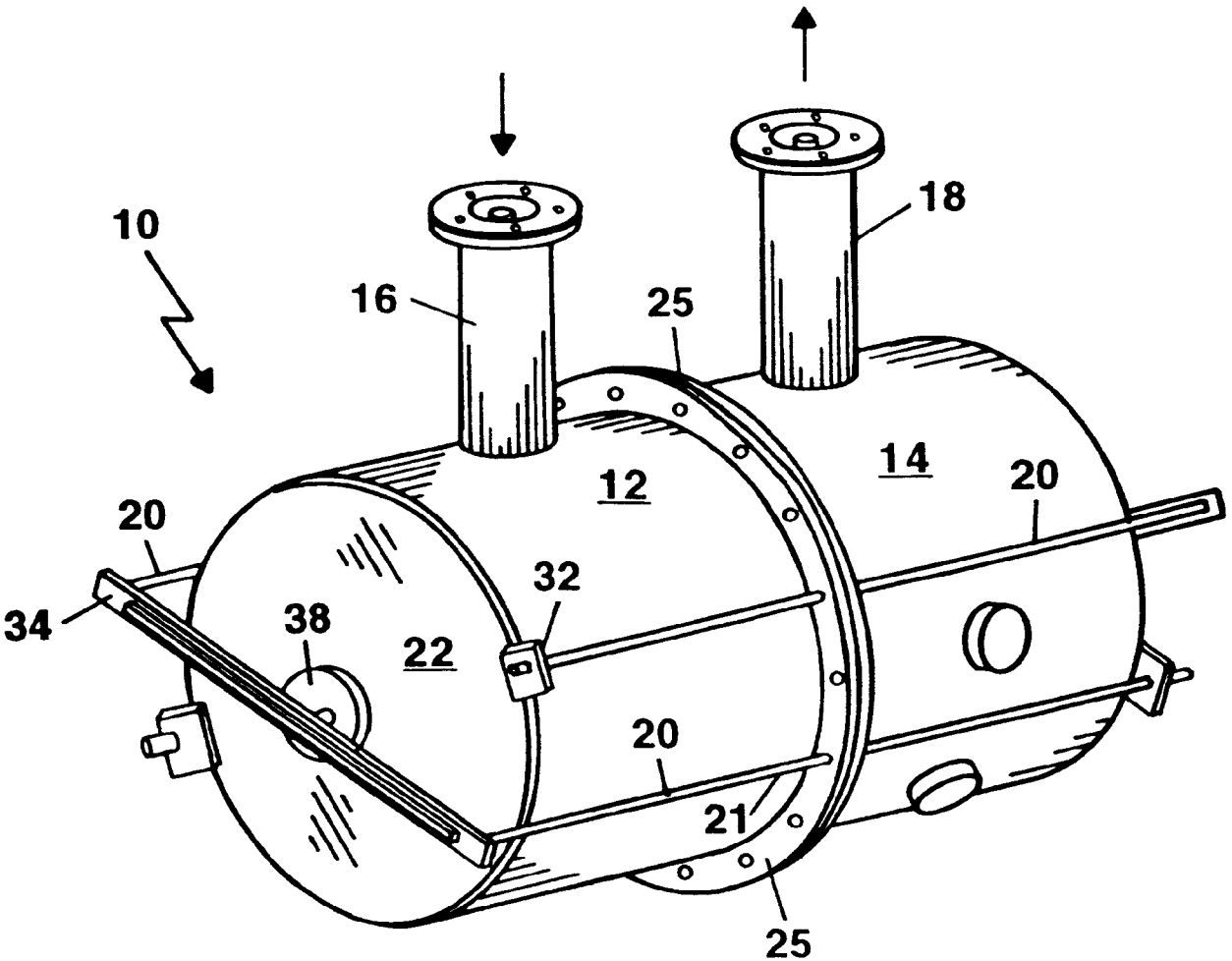
FIG. 5 is a perspective view of an alternative embodiment of the invention in which additional deflection of the filter cavity end plates is provided using extension disks.

In one variation of the preferred embodiment, the effective length of $l_{ALUM}$ is increased by attaching an extension, such as a disk, to the outside of the end plate being deflected. For example, as shown in FIG. 5, disk 38 may be used to increase the degree of deflection provided to the end plate 22. The magnitude of this increase may be controlled through selection of the material used for disk 38. For example, in the embodiment of FIG. 5, the disk 38 may be made of aluminum. In such a case, the thermal expansion of the disk would result in a much higher deflection of the end plate 22 for a given temperature than it would if it was made of a material having a lower coefficient of thermal expansion. Naturally, selection of the disk material, given the foregoing description, is well within the ability of those having ordinary skill in the art.

Figure 6:
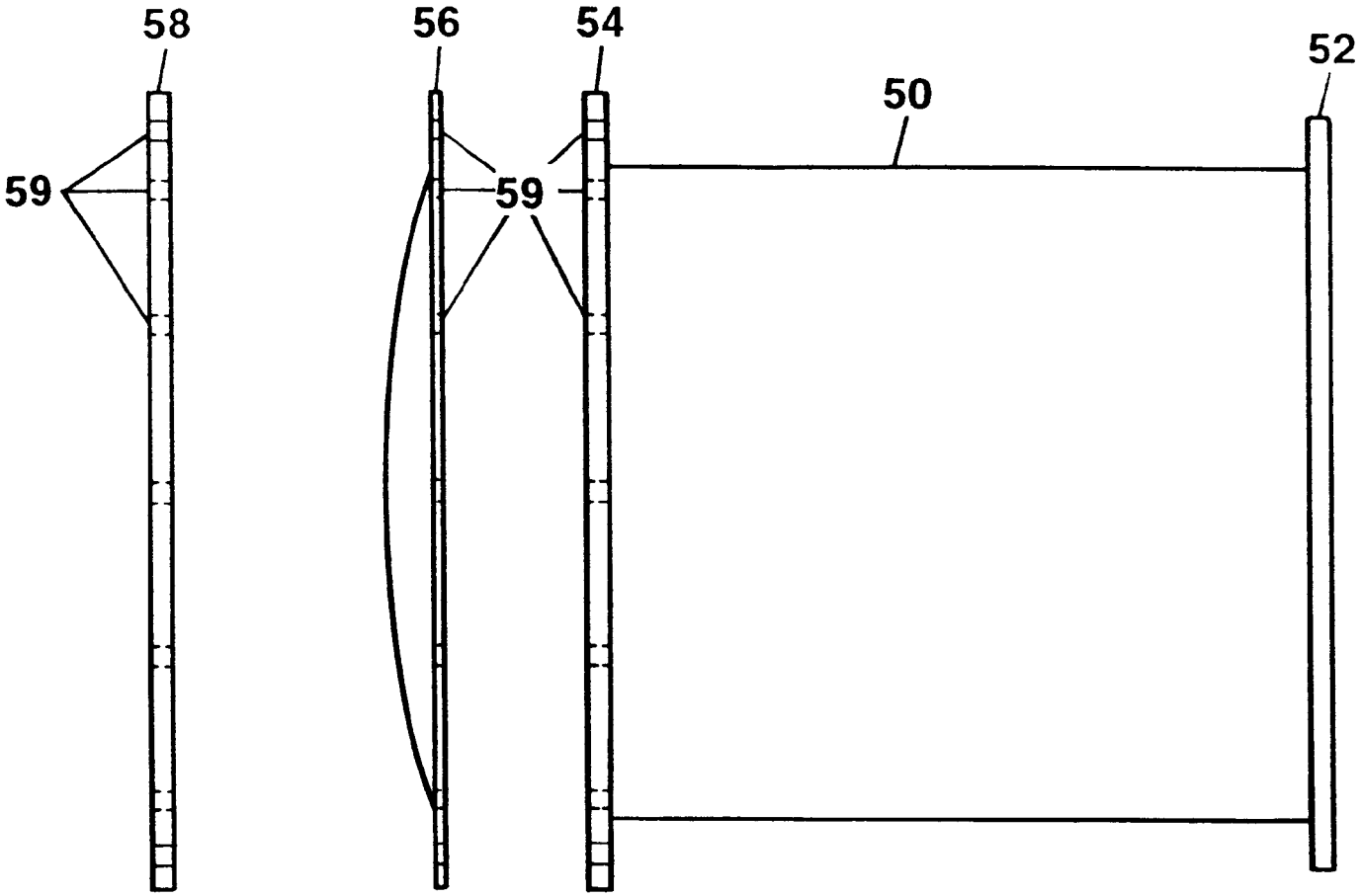
FIG. 6 is a cross-sectional side view of another alternative embodiment of the invention in which a filter cavity is provided with a convex end plate that deforms to compensate for thermal expansion.

An alternative embodiment of the invention is shown in FIG. 6. Depicted in the figure is a cross sectional, exploded view of one $TE_{112}$ dual mode cavity. Typically, this cavity would be combined with others to form a multiple cavity filter. However, it is shown alone in FIG. 6 for purposes of description. In this embodiment, the cavity is provided with an end plate that is specifically shaped to compensate for thermal expansion of cavity surfaces. As shown, the cavity 50 is cylindrically shaped, like those of the foregoing embodiments, and is typically made of aluminum. An iris plate would typically be used adjacent to the side 52 of the cavity, allowing it to be coupled to an adjacent cavity.

The cavity 50 also has a lip 54 that is configured to receive an end plate 56. However, rather than being flat, a portion of the end plate is convex relative to the cavity 50. That is, it has dome shape extending toward the outside of the cavity. An annular retaining ring 58 mounts over an outer edge of the end plate to keep it in place. The retaining ring 58, an outer portion of the end plate 56 and the lip 54 have holes 59 (only some of which are identified in the figure) arranged at various radial positions that align with one another to receive bolts or other retaining means. This allows the end plate 56 to be firmly secured to the cavity 50. Those skilled in the art will recognize that while bolts and a retaining ring are used in the present embodiment, other securing means may also be used for attaching the end plate to the cavity housing.

As mentioned previously, heating of a filter housing causes both radial and axial expansion that can distort the frequency response of the filter. At an initial temperature a filter, including cavities having convex end plates 56, provides a desired filter characteristic. As the temperature of the filter increases, a given filter cavity begins to grow both in length and in radius. While this would ordinarily result in a shifting of the filter characteristic due to the changing cavity dimensions, the convex end plate of the present embodiment changes shape in such a way as to minimize the effects of the thermal expansion on the filter response.

As a filter cavity such as that shown in FIG. 6 grows in radial dimension due to thermal expansion, the end plate, which is rigidly secured to the cavity housing, is stressed in a number of different radial directions distributed equally around the periphery of the end plate. In the preferred embodiment, the end plate is constructed from a material, such as copper, that has a lower coefficient of thermal expansion than that of the main section of the filter cavity. Therefore, there is a lower degree of expansion on the part of the end plate, and the end plate is pulled in numerous opposing radial directions. For example, if the end plate is connected to the main section of the filter housing at twelve equally spaced points about its periphery, these twelve points, in combination with the relative rigidity of the end plate material, cause the stress on the convex portion of the end plate to be essentially in all radial directions simultaneously. This force on the end plate 56 causes its shape to distort such that the convex portion of the end plate is drawn toward the plane in which the outer portion of the end plate is secured to the housing 50. In other words, the "dome" shape of the end plate 56 grows smaller, and the overall profile of the end plate becomes flatter. This distortion of the end plate has the effect of countering any increase in volume of the cavity that would otherwise be brought on by the thermal expansion of the housing 50, and tends to minimize changes in the filter response that would thereby result.

A particular filter design according to the present invention depends on the particular application for which the filter is intended. Those skilled in the art will recognize the need to adapt the general design disclosed herein to an application at hand. Although different shapes may be used for the convex portion of the end plate, in the preferred embodiment, the dome portion of the end plate has a shape that is a section of a sphere. That is, the dome has a constant radius along its surface relative to a common center point. Empirical data collection may be used as part of an overall design strategy. For example, an initial dome size may be selected, and the change in frequency response of the filter using that dome measured over the expected operating temperature range. This may be repeated with several other dome sizes, and a corresponding response curve generated that indicates dome size relative to frequency shift. An appropriate dome size is then selected at the point at which the frequency shift on the curve most closely approaches zero.

Figure 6A:
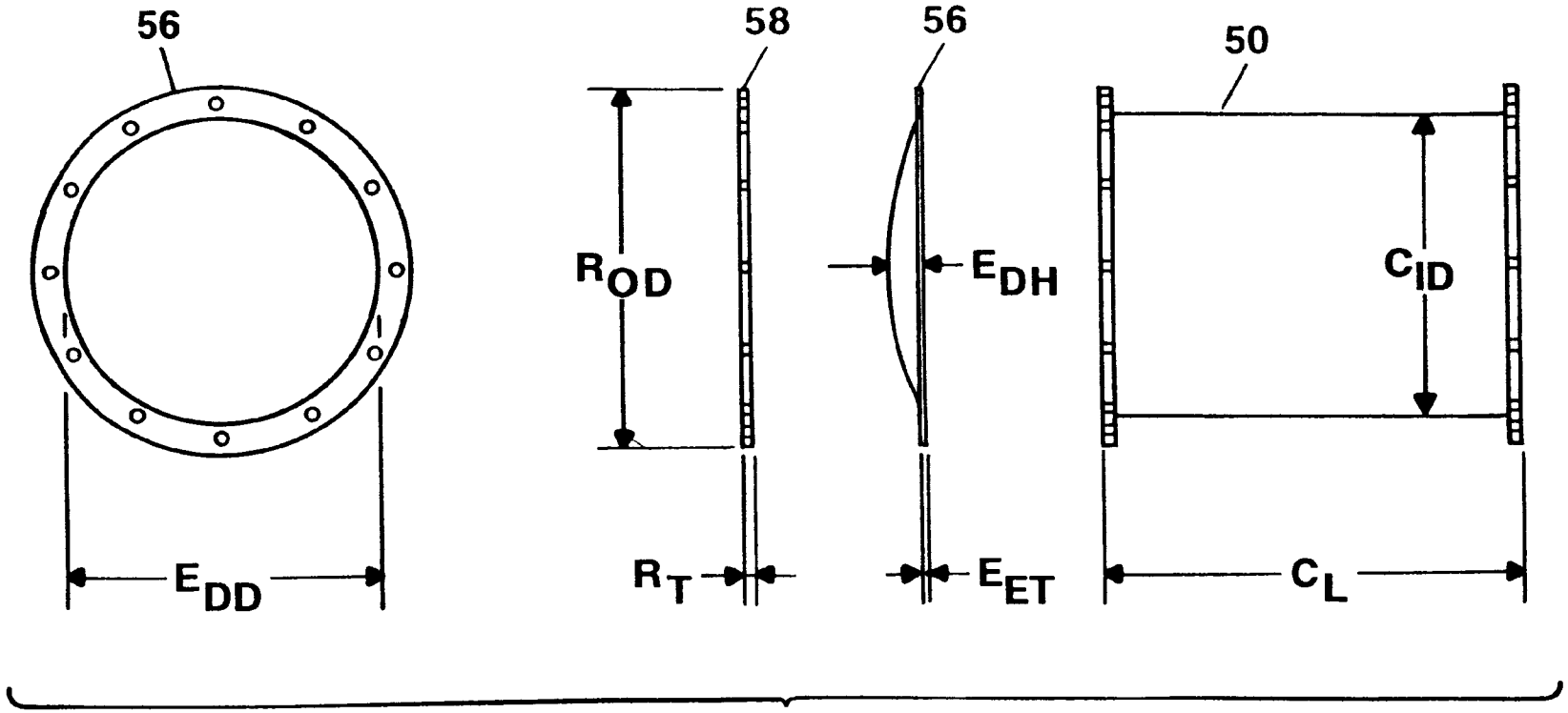
FIG. 6A depicts components of the filter cavity shown in FIG. 6, with various dimensions identified.

A specific example of a filter cavity according to a preferred embodiment of the invention may be described in conjunction with FIG. 6A, which identifies certain dimensions of the filter components. This embodiment of the filter has a cavity resonant frequency of 728 MHz, and uses a cylindrical cavity 50 having an inside diameter $C_{ID}$=15". The overall length of the cavity $C_L$=21.94". In the front view of end plate 56 in FIG. 6, the diameter of the dome section is shown. For this example, the dome diameter $E_{DD}$=14.75". The end plate 56 is also shown in side view, and the periphery edge of the end plate has a thickness $E_{ET}$=0.062". The height of the dome is measured at its peak and, for this example, is $E_{DH}$=0.24". The retaining ring 58 is also shown in the figure, and has an outside diameter $R_{OD}$=18" and a thickness $R_T$=0.50". The retaining ring 58 in this example has an inside diameter (not shown) that matches the inside diameter of the cylindrical portion of the cavity, i.e., 15". A filter cavity having these dimensions was tested and shown to be stable in frequency (within a useful tolerance range) for temperatures from 10° C. to 60° C., which is a normal operating temperature range for a filter of this type. However, it is expected that this filter would show good stability over an even wider temperature range.

Figure 7:
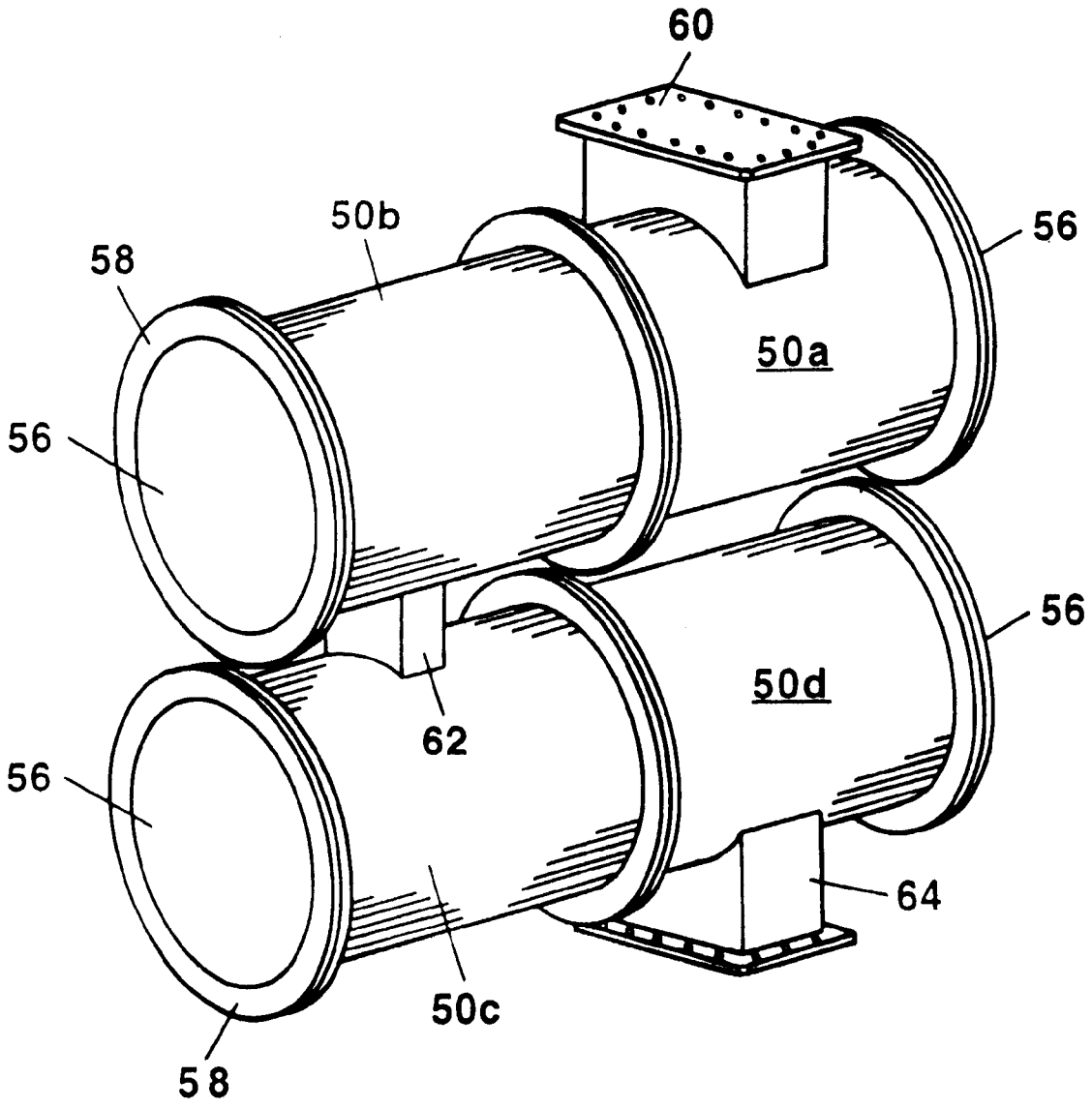
FIG. 7 is a perspective view of a filter using four temperature compensated cavities like that shown in FIG. 6.

Shown in FIG. 7 is a temperature-compensated cavity embodiment like that of FIG. 6 as used in a typical filter configuration. The filter shown is an n=8 pseudo-elliptic function filter using dual TE11n mode cavities. Each of the four cavities of the filter has a convex end plate 56, such that each has its own independent temperature compensation. In operation, an input signal is coupled into the cavity 50*a* via propagating waveguide input 60. An iris plate between cavity 50*a* and cavity 50*b* allows energy to be coupled between them, as known in the prior art. From cavity 50*b*, the signal is coupled to cavity 50*c* via an evanescent guide 62. The evanescent guide is also known in the art, and allows controllable coupling between the adjacent cavity sections. The signal is coupled from cavity 50*c* to 50*d* with a second iris plate between them, that also functions in a known manner. The filtered signal is output from cavity 50*d* via propagating waveguide output 64.

The filter shown in FIG. 7 provides high order filtering of a high power input signal, and is useful for applications such as television broadcasting. Each of the cavity sections of the filter are provided with a convex end plate 56 that counters shifts in the filter characteristic that might otherwise be caused by thermal expansion of the filter cavity. Of course, this is just a preferred embodiment of the invention, and any variety of different filters may be constructed with a filter cavity such as has been described herein.

While the invention has been shown and described with regard to a preferred embodiment thereof, it will be recognized by those skilled in the art that various changes in form and detail may be made herein without departing from the spirit and scope of the invention as defined by the appended claims. In particular, those skilled in the art will recognize that many other filter designs and surface shapes may be used that follow the principles of the invention disclosed herein. For example, if a convex surface is used in a filter for temperature compensation, it need not be on the end plate. Moreover, such a convex portion does not have to be dome-shaped, and may have any of a number of different configurations. Such variations of the invention described herein are considered to be within the scope of the invention.

What is claimed is:

1. A temperature-compensated bandpass filter for terrestrial television broadcast communications comprising a thin-walled waveguide cavity in which an input electrical signal resonates at a desired resonant frequency, the cavity comprising a body having an open end with a radial outward lip which extends radially outwardly from the side walls of said body and is closed by an end plate having a peripheral rim which mates with said lip, said body being composed of a first material having a first coefficient of thermal expansion and said end plate being composed of a second material having a lower coefficient of thermal expansion than said first material, the end plate having a central convex portion that projects in a direction away from an interior of the cavity, said cavity body responding to temperature increases by expanding in dimension, such expansion causing a flattening of the central convex portion of the end plate toward the interior of the cavity, said lip having both radial and axial thicknesses which are significantly greater than the wall thickness of said peripheral rim and said cavity body, and thereby being effective to provide primary resistance to radial forces created in said end plate.

2. A bandpass filter comprising a waveguide cavity for terrestrial television broadcast communications in which an input electrical signal resonates at a desired resonant frequency, the cavity having thin walls and a plurality of surfaces each with a predetermined geometric shape, said surfaces comprising an end plate connected along its periphery to an adjacent portion of the cavity by a ring structure having both radial and axial thicknesses which are significantly greater than the wall thickness of said cavity, and thereby being effective to provide resistance to radial forces created in said end plate, the end plate having a preformed convex portion that projects in a direction away from an interior of the cavity relative to the connection plane, the waveguide cavity comprising a first waveguide cavity, and the filter further comprising a second waveguide cavity coupled with the first waveguide cavity so as to receive a filtered version of the input signal via coupling with the first waveguide cavity.

3. A filter according to claim 2 wherein the filter is an eight-section filter and comprises four waveguide cavities.

4. A filter according to claim 3 wherein two of the waveguide cavities are coupled by an evanescent guide.

5. A filter according to claim 1 wherein said dimensional increase of the cavity causes stress to be applied to the end plate in directions substantially perpendicular to said direction in which the inner surface projects.

6. A bandpass filter comprising a waveguide cavity for terrestrial broadcast communications in which an input electrical signal resonates at a desired resonant frequency, the cavity having thin walls and a plurality of surfaces each with a predetermined geometric shape, at least one of the surfaces being subject to thermal expansion upon an increase in the filter temperature, said thermal expansion resulting in an increase in dimensions of the cavity, the cavity further comprising a convex end plate connected along its periphery to an adjacent portion of the cavity along a connection plane, the end plate having a preformed convex portion that projects away from an interior of the cavity relative to the connection plane and is distorted by said dimensional increase of the cavity such as to inhibit any change in the desired resonant frequency due to said increase in cavity dimensions, said end plate being secured around said periphery to the cavity by a robust retaining ring having both radial and axial thicknesses which are significantly greater than the wall thickness of the thin-walled cavity which is adapted to withstand the radial forces produced by said end plate during temperature-induced increases in cavity dimensions.

7. A bandpass filter comprising a waveguide cavity for terrestrial broadcast communications in which an input electrical signal resonates at a desired resonant frequency, the cavity having thin walls and a plurality of surfaces each with a predetermined geometric shape, at least one of the surfaces being subject to thermal expansion upon an increase in the filter temperature, said thermal expansion resulting in an increase in dimensions of the cavity, the cavity further comprising an end plate connected along its periphery to an adjacent portion of the cavity along a connection plane by an end plate contraction-resisting and plate-retention structure, the end plate having a preformed convex portion that projects away from an interior of the cavity relative to the connection plane and is distorted by said dimensional increase of the cavity such as to inhibit any change in the desired resonant frequency due to said increase in cavity dimensions, the waveguide cavity comprising a first waveguide cavity, and the filter further comprising a second waveguide cavity coupled with the first waveguide cavity so as to receive a filtered version of the input signal via coupling with the first waveguide cavity, said structure having both radial and axial thicknesses which are significantly greater than the wall thickness of the thin-walled cavity to provide resistance to radial forces created in said end plate when it is distorted.

8. A filter according to claim 6 wherein said dimensional increase of the cavity causes stress to be applied to the end plate in directions substantially perpendicular to an axis of symmetry of the end plate convexity.

9. A bandpass filter for terrestrial broadcast communications comprising: at least one pair of coaxial waveguide cavities in which an input electrical signal resonates at a desired resonant frequency, each cavity having a thin wall and a plurality of surfaces each with a predetermined geometric shape, surfaces of the cavities being subject to thermal expansion upon an increase in filter temperature, said thermal expansion resulting in an increase in dimensions of each cavity, each cavity further comprising an end plate connected along its edge to an adjacent portion of the cavity along a connection plane by an end plate contraction-resisting and plate-retention structure, each end plate having a convex central region that projects away from an interior of the cavity relative to the connection plane and is distorted by said dimensional increase of the cavity such as to inhibit any change in the desired resonant frequency due to said increase in cavity dimensions, said structure having both radial and axial thicknesses which are significantly greater than the wall thickness of the thin-walled cavity to provide resistance to radial forces created in said end plate when it is distorted.

10. A filter according to claim 9 wherein said dimensional increase of each cavity causes stress to be applied to the end plate of that cavity in directions substantially perpendicular to said direction in which the inner surface of that end plate projects.

11. The filter defined by claim 1 including a retaining ring which retentively mates with and secures said rim of said end plate to said lip of said cavity body.

12. The filter defined by claim 11 wherein said retaining ring is secured to said end plate rim and lip at a predetermined number of equally spaced locations chosen such that the stress on the convex portion of the end plate is essentially the same in all radial directions.

13. The filter defined by claim 11 wherein said retaining ring is sufficiently robust to withstand the radial forces produced by said end plate when the temperature of said cavity increases.

14. The filter defined by claim 13 wherein said ring is approximately 0.5 inch thick and 1.5 inches in radial dimension.

15. The filter defined by claim 12 wherein said retaining ring is sufficiently robust to withstand the radial forces produced by said end plate when the temperature of said cavity increases.

16. The filter defined by claim 15 wherein said ring is approximately 0.5 inch thick and 1.5 inches in radial dimension.

17. The filter defined by claim 1 wherein the thickness of said peripheral rim is significantly less than the thickness of said retaining ring.

18. The filter defined by claim 17 wherein said rim is approximately one-eighth as thick as said retaining ring.

19. The filter defined by claim 1 wherein said first material is aluminum, and wherein said second material is copper or Invar.

20. The filter defined by claim 11 wherein said lip, rim and ring have approximately the same inner and outer diameters.

21. The filter defined by claim 1 wherein said convex portion comprises a section of a sphere.

22. The filter defined by claim 1 wherein said cavity body is cylindrical, and wherein said convex portion of said end plate has a diameter less than the diameter of said cavity body.

23. The filter defined by claim 1 wherein said convex portion of said end plate is sized to minimize frequency variations with variations in temperature of said cavity body.

24. The filter defined by claim 2 wherein said first and second cavities are coupled by an iris.

25. The filter defined by claim 2 wherein said first and second cavities are coupled by an evanescent guide.

26. A filter comprising two pairs of first and second temperature-compensated waveguide cavities, each pair as defined by claim 2, and wherein said filter pairs are coupled by an evanescent guide.

27. The filter defined by claim 26 wherein in each pair of cavities the cavities are coupled by an iris.

28. The filter defined by claim 2 wherein each of said cavities comprises a body having an open end with a radial outward lip which is closed by said end plate, said end plate having a peripheral rim which mates with said lip.

29. The filter defined by claim 28 wherein each cavity includes a retaining ring which retentively mates with and secures said rim of said end plate to said lip of said cavity body.

30. The filter defined by claim 29 wherein said retaining ring is secured to said end plate rim and lip at a predetermined number of equally spaced locations chosen such that the stress on the convex portion of the end plate is essentially the same in all radial directions.

31. The filter defined by claim 29 wherein said retaining ring is sufficiently robust to withstand the radial forces produced by said end plate when the temperature of said cavity increases.

32. The filter defined by claim 31 wherein said ring is approximately 0.5 inch thick and 1.5 inches in radial dimension.

33. The filter defined by claim 30 wherein said retaining ring is sufficiently robust to withstand the radial forces produced by said end plate when the temperature of said cavity increases.

34. The filter defined by claim 33 wherein said ring is approximately 0.5 inch thick and 1.5 inches in radial dimension.

35. The filter defined by claim 29 wherein the thickness of said peripheral rim is significantly less than the thickness of said retaining ring.

36. The filter defined by claim 35 wherein said rim is approximately one-eighth as thick as said retaining ring.

37. The filter defined by claim 2 wherein each of said cavity bodies is composed of aluminum, and wherein each of said end plates is composed of copper or Invar.

38. The filter defined by claim 29 wherein said lip, rim and ring have approximately the same inner and outer diameters.

39. The filter defined by claim 2 wherein in each of said cavities said convex portion of said end plate comprises a section of a sphere.

40. The filter defined by claim 2 wherein in each of said cavities, said cavity body is cylindrical, and wherein said convex portion of said end plate has a diameter less than the diameter of said cavity body.

41. The filter defined by claim 2 wherein in each of said cavities, said convex portion of said end plate is sized to minimize frequency variations with variations in temperature of said cavity body.

42. A temperature-compensated bandpass filter for terrestrial television broadcast communications comprising a waveguide cavity in which an input electrical signal resonates at a desired resonant frequency, the cavity comprising a thin-walled body having an open end which is closed by an end plate having a rim portion, said body being composed of a first material having a first coefficient of thermal expansion and said end plate being composed of a second material having a lower coefficient of thermal expansion than said first material, the end plate having a central convex portion that projects in a direction away from an interior of the cavity, said cavity body responding to temperature increases by expanding in dimension, such expansion causing a flattening of the central convex portion of the end plate toward the interior of the cavity, said filter including an end plate contraction-resisting-and-retention structure positioned at the end of the cavity at which said end plate is located which affixes the rim portion of said end plate to said cavity body, said structure having a rim-engaging portion with both radial and axial thicknesses which are significantly greater than the wall thickness of said thin-walled cavity body to provide resistance to radial forces created in said end plate as a result of the difference in coefficients of thermal expansion of said end plate and said cavity body.

43. The filter defined by claim 42 wherein said structure comprises a retaining ring which is affixed to said rim portion of said end plate and to said cavity body, said retaining ring having both radial and axial thicknesses which are significantly greater than the wall thickness of the cavity body.

* * * * *